United States Patent [19]

Schläpfer, deceased et al.

[11] 4,141,900

[45] Feb. 27, 1979

[54] 3-PHENYL-7-(v-TRIAZOL-2-YL)-COUMARINS

[75] Inventors: Hans Schläpfer, deceased, late of Basel, Switzerland, by Nelly Schläpfer, heiress; by Alex R. Schläpfer, heir

[73] Assignee: Ciba-Geigy Corporation, Ardsley, N.Y.

[21] Appl. No.: 777,995

[22] Filed: Mar. 16, 1977

[30] Foreign Application Priority Data

Mar. 26, 1976 [CH] Switzerland ..... 3813/76

[51] Int. Cl.[2] ..... C07D 405/04; C07D 413/04; C09K 1/02

[52] U.S. Cl. ..... 260/308 A; 8/1 W; 252/301.25; 252/301.26; 252/301.29; 260/343.45; 544/132; 546/196

[58] Field of Search ..... 260/308 A, 247.2 B, 260/293.58

[56] References Cited

U.S. PATENT DOCUMENTS

| | | | |
|---|---|---|---|
| 3,496,189 | 2/1970 | Wirth et al. | 260/308 B |
| 3,542,689 | 11/1970 | Kirchmayr et al. | 252/301.2 |
| 3,646,052 | 2/1972 | Neuner et al. | 260/308 A |
| 3,839,352 | 10/1974 | Kirchmayr et al. | 260/308 A |

FOREIGN PATENT DOCUMENTS

| | | | |
|---|---|---|---|
| 2335218 | 1/1975 | Fed. Rep. of Germany | 260/308 A |

*Primary Examiner*—Alton D. Rollins
*Attorney, Agent, or Firm*—Edward McC. Roberts; Prabodh I. Almaula

[57] ABSTRACT

Novel 3-phenyl-7-(v-triazol-2-yl)-coumarins of the formula

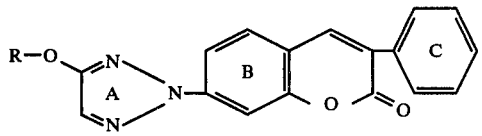

wherein R represents hydrogen, unsubstituted or substituted alkyl, alkenyl, alkanyol, aroyl, aralkyl, alkoxycarbonyl, carbamoyl or v-epoxyalkyl, the rings A, B and C being optionally substituted with further non-chromophoric substituents, processes for their preparation as well as a process for optically brightening organic material on using said compounds are disclosed.

2 Claims, No Drawings

3-PHENYL-7-(v-TRIAZOL-2-YL)-COUMARINS

The present invention relates to novel 3-phenyl-7-(v-triazol-2-yl)-coumarins, a process for their manufacture and to the use thereof as fluorescent brighteners for organic material.

The novel 3-phenyl-7-(v-triazol-2-yl)-coumarins have the formula

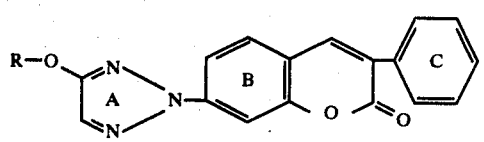

(1)

wherein

R represents a hydrogen atom or an unsubstituted or substituted alkyl, alkenyl, alkanoyl, aroyl or aralkyl, alkoxycarbonyl, carbamoyl or v-epoxyalkyl group, whilst the ring A can contain one additional non-chromophoric substituent and the rings B and C can contain still further non-chromophoric substituents.

Suitable groups referred to in the definition of R are in particular:alkyl groups of 1 to 12, preferably of 1 to 4, carbon atoms, which can be substituted by alkoxy groups of 1 to 4 carbon atoms, carbalkoxy groups containing a total of 2 to 5 carbon atoms or hydroxyl, carboxyl or cyano groups; alkenyl groups of 3 to 5, preferably 3, carbon atoms; aralkyl groups, preferably benzyl groups, which can be substituted in the phenyl nucleus by lower alkyl, preferably methyl, groups, lower alkoxy groups or by halogen, preferably chlorine, atoms; alkanoyl groups containing a total of 2 to 12 carbon atoms which can be substituted by halogen atoms, lower alkoxy, carboxyl, carbalkoxy, cyano or hydroxyl groups; aroyl groups, preferably monocyclic groups, in particular the benzoyl group, which can be substituted in the phenyl nucleus by lower alkyl or lower alkoxy groups or halogen atoms; alkoxycarbonyl groups which contain 1 to 12 carbon atoms in the alkoxy moiety, carbamoyl groups of the formula $—CONY_1Y_2$, wherein each of $Y_1$ and $Y_2$ independently represents a hydrogen atom or a lower alkyl group; and v-epoxyalkyl groups of 3 to 12 carbon atoms, for example 2,3-epoxypropyl, 2,3-epoxybutyl groups.

By "halogen" are meant chlorine or bromine atoms, preferably chlorine atoms, and the term "lower" qualifying alkyl and alkoxy groups denotes that these groups contain from 1 to 4 carbon atoms.

By non-chromophoric substituents of the rings A, B and C are meant for example: alkyl groups of 1 to 12, preferably 1 to 4, carbon atoms, cyclohexyl groups, phenylalkyl groups containing 1 to 3 carbon atoms in the alkyl moiety, phenyl which is unsubstituted or substituted by 1 or 2 members selected from the group consisting of halogen, alkyl or alkoxy of 1 to 4 carbon atoms; diphenylyl or naphthyl; alkoxy groups of 1 to 12, preferably 1 to 4, carbon atoms; phenoxy which is unsubstituted or substituted by 1 or 2 members selected from the group consisting of chlorine, methyl or methoxy; halogen, preferably chlorine, fluorine or bromine atoms; cyano groups; —COOY, wherein Y represents a hydrogen atom, a salt-forming cation, an alkyl group of 1 to 4 carbon atoms or a benzyl group; $CONY'(Y_1')$, wherein Y' represents a hydrogen atom, an alkyl group of 1 to 6 carbon atoms, a hydroxyalkyl group of 1 to 4 carbon atoms, an alkoxyalkyl group of 2 to 8 carbon atoms, a phenyl or benzyl group and $Y_1'$ represents a hydrogen atom, an alkyl group of 1 to 6 carbon atoms, a hydroxyalkyl group of 1 to 4 carbon atoms or an alkoxyalkyl group of 2 to 8 carbon atoms, or Y' and $Y_1'$ together with the nitrogen atom to which they are attached represent a morpholino or piperidino radical; $—SO_2OY''$, wherein Y'' represents an alkyl group of 1 to 5 carbon atoms or a benzyl group, $—SO_2NY'(Y_1')$, wherein Y' and $Y_1'$ are as defined above; an alkylsulphonyl group of 1 to 6, preferably 1 to 4 carbon atoms, a benzylsulphonyl or phenylsulphonyl group which is unsubstituted or substituted by chlorine or methyl, the group $—CH_2—Z$, wherein Z represents a hydroxyl group, a benzyloxy group which is unsubstituted or substituted by alkyl or alkoxy of 1 to 4 carbon atoms or by halogen, an alkanoyloxy group of 1 to 4 carbon atoms, an alkoxy or mercapto group of 1 to 4 carbon atoms, a dialkylamino group which contains 1 to 4 carbon atoms in each alkyl moiety, a morpholino or piperidino group which is unsubstituted or substituted by methyl, or, if two substituents in the ortho-position are present, also an alkylene group containing 3 or 4 carbon atoms or a 1,3-butadienylene group.

Salt forming cations are to be understood as meaning alkali metal, alkaline earth metal, ammonium and amine salt ions.

Preferred coumarins of the formula (1) are the 3-phenyl-7-(v-triazol-2-yl)-coumarins of the formula

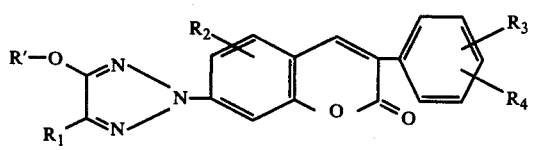

(2)

wherein

R' represents a hydrogen atom, an alkyl group of 1 to 12 carbon atoms which is unsubstituted or substituted by alkoxy, hydroxyl, carboxyl, carbalkoxy or cyano, an alkenyl group of 3 to 5 carbon atoms, an unsubstituted or substituted alkanoyl group of 2 to 12 carbon atoms, an aroyl, aralkyl or v-epoxy-alkyl group of 3 to 12 carbon atoms, $R_1$ represents a hydrogen atom, a chlorine or bromine atom, an alkyl group of 1 to 12 carbon atoms, an aryl group or the $—CH_2—Z$ group, wherein Z represents a hydroxyl group, a benzyloxy group which is unsubstituted or substituted by alkyl or alkoxy of 1 to 4 carbon atoms or by halogen, an alkanoyloxy group of 1 to 4 carbon atoms, an alkoxy or alkylmercapto group of 1 to 4 carbon atoms, a dialkylamino group which contains 1 to 4 carbon atoms in each alkyl moiety, a morpholino or piperidino group which is unsubstituted or substituted by methyl, $R_2$ represents a hydrogen atom, a halogen atom, an alkyl or alkoxy group of 1 to 4 carbon atoms, $R_3$ represents a hydrogen atom, a halogen atom, an alkyl or alkoxy group of 1 to 4 carbon atoms, the group —COOY, wherein Y represents a hydrogen atom, a salt forming cation or an alkyl group of 1 to 4 carbon atoms, an alkylsulphonyl group of 1 to 4 carbon atoms or a cyano group, and $R_4$ represents a hydrogen atom, a halogen atom, an alkyl or alkoxy group of 1 to 4 carbon atoms.

Particularly preferred compounds are the 3-phenyl-7-(v-triazol-2-yl)-coumarins of the formula

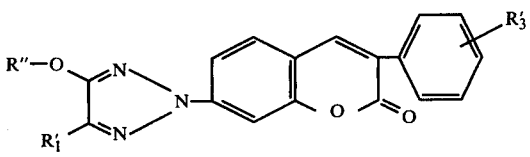

(3)

wherein

R'' represents an alkyl group of 1 to 4 carbon atoms, an allyl or benzyl group, $R_1'$ represents a hydrogen or chlorine atom, and $R_3'$ represents a hydrogen atom, a chlorine atom, an alkyl or alkoxy group of 1 to 4 carbon atoms. The preferred substituent $R_3'$ is a hydrogen atom, a methyl or methoxy group.

The most preferred compounds are the 3-phenyl-7-(v-triazol-2-yl)-coumarins of the formula

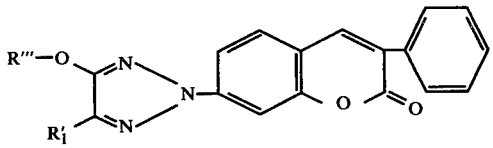

(4)

wherein

R''' represents an alkyl group of 1 to 4 carbon atoms or a benzyl group, and $R_1'$ represents a hydrogen or chlorine atom.

3-Phenyl-7-(v-triazol-2-yl)-coumarins of the formula (1) can be obtained in known manner by condensing, under cyclisation conditions, a compound of the formula

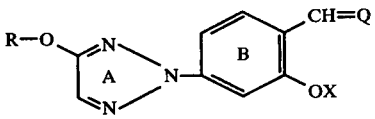

(5)

wherein R and the rings A and B have the meanings given above, and

Q represents an oxygen atom or an unsubstituted or substituted phenylimino group and X represents a hydrogen atom, an alkyl group of 1 to 4 carbon atoms or a phenylsulphonyl group, with an acetic acid derivative of the formula

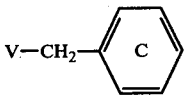

(6)

wherein the ring C has the meaning given above and V represents a carboxyl group or an alkali metal or ammonium salt thereof, an alkoxycarbonyl group which contains 1 to 4 carbon atoms in the alkoxy moiety, or the cyano group.

The 3-phenyl-7-(v-triazol-2-yl)-coumarins of the formula

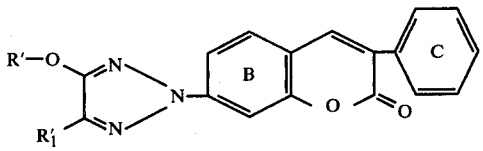

(7)

wherein the rings B and C can contain still further non-chromophoric substituents, R' represents a hydrogen atom, an alkyl group of 1 to 12 carbon atoms which is unsubstituted or substituted by alkoxy, hydroxyl, carboxyl, carbalkoxy or cyano; an alkenyl group of 3 to 5 carbon atoms, an unsubstituted or substituted alkanoyl group of 2 to 12 carbon atoms, an aroyl, aralkyl or v-epoxy-alkyl group of 3 to 12 carbon atoms, and $R_1'$ represents a hydrogen atom or a chlorine atom, can also be obtained by diazotising in known manner a 3-phenyl-7-amino-coumarin of the formula

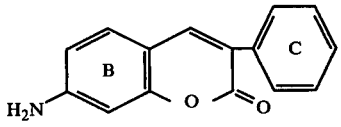

(8)

wherein the rings B and C can contain further non-chromophoric substituents, coupling the resultant diazonium compound with an α-nitrooxime, such as α-nitroacetaldoxime, of the formula $$O_2N - CH_2 - CH = NOH,$$

to give a compound of the formula

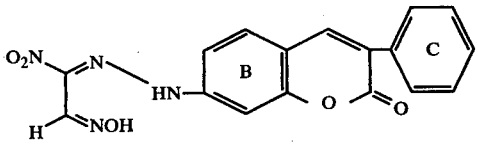

(9)

wherein the rings B and C have the above meanings, cyclising the compound of the formula (9) in acid medium to the corresponding 3-phenyl-7-(1'-oxido-4'-hydroxy-v-triazol-2'-yl)-coumarin of the formula

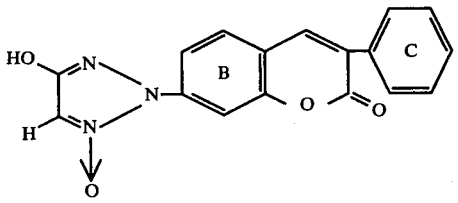

(10)

wherein the rings B and C have the above meanings, and reacting the compounds thereby obtained by reductive chlorination and alkylation or by reduction and alkylation to give 3-phenyl-7-(v-triazol-2-yl)-coumarins of the formula (7).

The starting materials of the formulae (5), (6) and (8) are known or they can be prepared in analogy to methods which are known per se.

The novel compounds of the present invention defined herein have a more or less pronounced fluorescence when in solution or suspension. They can be used for optically brightening a wide variety of synthetic man-made, regenerated man-made or natural organic material or substances which contain such material.

Without any restriction being implied by the following classification, examples of organic materials which can be optically brightened are:

I. Synthetic organic materials of high molecular weight (a) polymerisation products based on organic compounds containing at least one polymerisable carbon-carbon double bond, that is to say their homopolymers or copolymers as well as their aftertreatment products, for example, crosslinking, grafting or degradation products, polymer blends, or products obtained by modification of reactive groups, for example polymers based on $\alpha,\beta$-unsaturated carboxylic acids or derivatives of such carboxylic acids, especially on acrylic compound for example acrylic esters, acrylic acid, acrylonitrile, acrylic amides and their derivatives or their methacrylic analogues), on olefin hydrocarbons (for example ethylene, propylene, styrenes or dienes and also ABS polymers), and polymers based on vinyl and vinylidene compounds (for example vinyl chloride, vinyl alcohol and vinylidene chloride);

(b) polymerisation products which can be obtained by ring opening, for example, polyamides of the polycaprolactam type, and also polymers which are obtained both by polyaddition and by polycondensation, for example polyethers or polyacetals, (c) polycondensation products or precondensates based on bifunctional or polyfunctional compounds with condensable groups, their homocondensation and co-condensation products, and aftertreatment products, for example polyesters, especially saturated polyesters (for example ethylene glycol terephthalic acid polyester) or unsaturated polyesters (for example maleic acid-dialcohol polycondensates as well as their crosslinking products with copolymerisable vinyl monomers), unbranched and branched polyesters (also including those based on polyhydric alcohols, for example alkyd resins), polyamides (for example hexamethylenediamine adipate), maleic resins, melamine resins, their precondensates and analogues, polycarbonates and silicones;

(d) polyaddition products, such as polyurethanes (crosslinked and uncrosslinked) and expoxide resins.

II. Regenerated man-made organic materials, for example, cellulose esters of varying degrees of esterification (so-called 2½-acetate or triacetate) or cellulose ethers, regenerated cellulose (viscose or cuprammonium cellulose), or their aftertreatment products, and casein plastics.

III. Natural organic materials of animal or vegetable origin, for example based on cellulose or proteins, such as cotton, wool, linen, silk, varnish gums, starch and casein.

The organic materials to be optically brightened can be in the most diverse states of processing (raw materials, semi-finished goods or finished goods). On the other hand, they can be in the form of structures of the most diverse shapes, for example predominantly three-dimensional structures such as sheets, profiles, injection mouldings, various machined articles, chips, granules or foams, and also predominantly two-dimensional structures, such as films, foils lacquers, coatings and impregnations, or predominantly one-dimensional bodies, such as filaments, fibres, flocks and wires. The said materials can, on the other hand, also be in an unshaped state, in a wide variety of homogeneous or inhomogeneous forms of division, for example, in the form of powders, solutions, emulsions, dispersions, latices, pastes Fibrous materials can, for example, be in the form of endless filaments (stretched or unstretched), staple fibers, flocks, hanks, textile filament yarns, threads, nonwovens, felts, waddings, flocked structures or woven textile or bonded textile fabrics, knitted fabrics and papers, cardboards or paper pulps.

The compounds to be used according to the invention are of importance, inter alia, for the treatment of organic textile materials, especially woven textile fabrics. If fibres which can be in the form of staple fibres or endless filaments or in the form of hanks, woven fabrics, knitted fabrics, fleeces, flocked substrates or bonded fabrics, are to be optically brightened according to the invention, this is advantageously effected in an aqueous medium, wherein the compounds in question are present in a finely divided form (suspensions, so-called microdispersions, or optionally solutions). If desired, dispersing agents, stabilisers, wetting agents and further assistants can be added during the treatment.

Depending on the type of brightener compound used, it can be advantgeous to carry out the treatment in a neutral or alkaline or acid bath. The treatment is usually carried out at temperatures of 20° to 140° C., for example at the boiling point of the bath or near it (about 90° C.). Solutions or emulsions in organic solvents can also be used for the finishing according to the invention of textile substrates, as practised in the dyeing industry in so-called solvent dyeing (pad-thermofixing application, or exhaustion dyeing processes in dyeing machines).

The novel fluorescent brighteners of the present invention can further be added to, or incorporated in, the materials before or during their shaping. Thus they can for example be added to the compression moulding composition or injection moulding composition during the manufacture of films, sheets (for example working into polyvinyl chloride at elevated temperature in a roller mill) or mouldings.

If the fashioning of man-made synthetic or regenerated man-made organic materials is effected by spinning processes or from spinning solutions/melts, the fluorescent brighteners can be applied by the following processes:

addition to the starting substances (for example monomers) or intermediates (for example precondensates or prepolymers), that is to say before or during the polymerisation, polycondensation or polyaddition, sprinkling in powder form on polymer chips or granules for spinning solutions/melts, bath dyeing of polymer chips or granules for spinning solutions/melts, metered addition to spinning melts or spinning solutions, and application to the spun tow before stretching.

The fluorescent brighteners of the present invention can, for example, also be employed in the following use forms:

(a) in mixtures with dyestuffs (shading) or pigments (coloured pigments or especially, for example, white pigments), or as an additive to dye baths, printing pastes, discharge pastes or reserve pastes, or for the aftertreatment of dyeings, prints or discharge prints;

(b) in mixtures with carriers, wetting agents, plasticisers, swelling agents, anti-oxidants, ultraviolet adsorbers, heat stabilisers and chemical bleaching agents (chlorite bleach or bleaching bath additives);

(c) in admixture with crosslinking agents or finishing agents (for example starch or synthetic finishes), and in combination with a wide variety of textile finishing processes, especially synthetic resin finishes (for example creaseproof finishes such as wash-and-wear, permanent-press or non-iron), as well as flameproof finishes, soft handle finishes, antisoiling finishes or anti-static finishes, or antimicrobial finishes;

(d) incorporation of the fluorescent brighteners into polymeric carriers (polymerization, polycondensation or polyaddition products, in a dissolved or dispersed form, for use, for example, in coating agents, impregnating agents or binders (solutions, dispersions and emulsions) for textiles, non-wovens, papers and leather;

(e) as additives to master batches;

(f) as additives to a wide variety of industrial products in order to render these more marketable (for example improving the appearance of soaps, detergents, pigments);

(g) in combination with other optically brightening substances;

(h) in spinning bath preparations, that is to say as additives to spinning baths which are used for improving the slip for the further processing of synthetic fibres, or from a special bath before the stretching of the fibre;

(i) as scintillators for various purposes of a photographic nature, for example for electrophotographic reproduction or suspersensitising;

(j) depending on the substitution as laser dyes.

If the brightening process is combined with textile treatment or finishing methods, the combined treatment can in many cases advatageously be carried out with the aid of appropriate stable preparations which contain the fluorescent brightener compounds in such a concentration that the desired brightening effect is achieved.

In certain cases, the fluorescent brighteners are made fully effective by an after-treatment. This can be, for example, a chemical treatment (for example acid treatment), a thermal treatment (for example heat) or a combined chemical/thermal treatment. Thus, for example, the appropriate procedure to follow in brightening a number of fibrous substrates, for example polyester fibres, with the fluorescent brighteners of the invention, is to impregnate these fibres with the aqueous dispersions (or optionally also solutions) of the brighteners at temperatures below 75° C., for example at room temperature, and to subject them to a dry heat treatment at temperatures above 100° C., it being generally advisable additionally to dry the fibrous material beforehand at a moderately elevated temperature, for example at not less than 60° C. to about 130° C. The heat treatment in the dry state is then advantageously carried out at temperature between 120° and 225° C., for example by heating in a drying chamber, by ironing within the specified temperature range or by treatment with dry, superheated steam. The drying and dry heat treatment can also be carried out in immediate succession or be combined in a single process stage.

The amount of fluorescent brightener manufactured according to the invention to be used, referred to the weight of the material to be brightened, can vary within wide limits. A marked and lasting effect can be obtained even with very insignificant amounts, in certain cases 0.0001 percent by weight. But it is also possible to use amounts of up to app. 0.8 percent by weight and, on occasion, up to app. 2 percent by weight. For most practical purposes, it is preferable to use amounts between 0.005 and 1 percent by weight.

For various reasons it is often advantageous not to use the fluorescent brighteners by themselves, i.e. pure, but in admixture with a wide variety of assistants and extenders, for example anhydrous sodium sulphate, sodium sulphate decahydrate, sodium chloride, sodium carbonate, alkali metal phosphates, such as sodium or potassium orthophosphate, sodium or potassium pyrophosphate and sodium or potassium tripolyphosphates or alkali metal silicates.

The fluorescent brighteners of this invention are also particularly suitable for use as additives to wash liquors or heavy duty and domestic detergents, to which they can be added in various ways. They are appropriately added to wash liquors in the form of their solutions in water or organic solvents or, in a finely divided form, as aqueous dispersions. They are advantageously added to domestic or heavy duty detergents in any stage of the manufacturing process of the detergents, for example to the slurry before the washing powder is atomised, or during the preparation of liquid detergent combinations. They can be added either in the form of a solution or dispersion in water or other solvents or, without assistants, as a dry brightening powder. For example, the brightening agents can be mixed, kneaded or ground with the active detergents and, in this form, admixed with the finished powder. However, they can also be sprayed in a dissolved or pre-dispersed form on the finished detergent.

Suitable detergents are the known mixtures of active detergents, for example soap in the form of chips and powders, synthetics, soluble salts of sulphonic acid hemiesters of higher fatty alcohols, higher and/or polyalkyl-substituted arylsulphonic acids, sulphocarboxylic acid esters of medium to higher alcohols, fatty acid acylaminoalkyl- or acylaminoaryl-glycerol sulphonates and phosphoric acid esters of fatty alcohols. Suitable builders which can be used are, for example, alkali metal polyphosphates and polymetaphosphates, alkali metal pyrophosphates, alkali metal salts of carboxymethylcellulose and other soil redeposition inhibitors, and also alkali metal silicates, alkali metal carbonates, alkali metal borates, alkali metal perborates, nitrilotriacetic acid, ethylenediaminotetraacetic acid, and foam stabilisers such as alkanolamides of higher fatty acids. The detergents can further contain for example: antistatic agents, fat restorative skin protection agents, such as lanolin, enzymes, anti-microbial agents, perfumes and colourants.

The novel fluorescent brighteners have the particular advantage that they are also active in the presence of active chlorine donors, for example, hypochlorite, and can be used without significant loss of effect in wash liquors containing non-ionic washing agents, for example alkylphenolpolyglycol ethers.

The compounds of the present invention are added in amounts of 0.005 to 1% or more, based on the weight of the liquid or pulverulent finished detergent. Wash liquors which contain the indicated amounts of the claimed fluorescent brighteners impart a brilliant appearance in daylight when used to wash textiles made from cellulose fibres, polyamide fibres, cellulose fibres with a high quality finish, polyester fibres or wool.

The washing treatment is carried out as follows, for example:

The textiles are treated for 1 to 30 minutes at 20° to 100° C. in a wash liquor which contains 1 to 10 g/kg of a built-up composite detergent and 0.05 to 1%, based on the weight of the detergent, of the fluorescent brighteners of the invention. The liquor ratio can be 1:3 to 1:50. After they have been washed, the textiles are rinsed and dried in the usual manner. The wash liquor can contain 0.2 g/l of active chlorine (for example as hypochlorite) or 0.1 to 2 g/l of sodium perborate as a bleaching additive.

In the following examples, parts and percentages are always by weight, unless otherwise stated. Unless indicated to the contrary, melting points and boiling points are uncorrected.

EXAMPLE 1

6.1 g of 3-phenyl-7-(4-hydroxy-v-triazol-2-yl)-coumarin are dissolved at room temperature in 75 ml of dimethyl formamide. After addition of 11 g of potassium carbonate and 12 ml of methyl iodide, the reaction mixture is stirred for 6 hours at an internal temperature of 60° C. Excess methyl iodide is then distilled off and the reaction mixture is thereafter poured into 1200 ml of water. The pH is adjusted to 3 with 2N sulphuric acid and the precipitated product is collected with suction, washed free of salt with water and dried. Two crystallisations from toluene with fuller's earth yield 4.85 g of the compound of the formula (101)

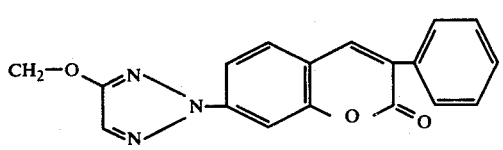

in the form of fine beige-coloured crystal needles with a melting point of 190°–191° C.

The 3-phenyl-7-(4-hydroxy-v-triazol-2-yl)-coumarin used as starting material was prepared as follows:

47.4 g of 3-phenyl-7-amino-coumarin are stirred for 16 hours in a mixture of 400 ml of water and 58.5 ml of 37.2% hydrochloric acid. The resultant beige solution is thereupon diazotised at 3° to 6° C., with good stirring, with a solution of 14 g of sodium nitrite in 75 ml of water and the diazo solution is stirred for 5 hours at the same temperature. Then 75 ml of sodium acetate solution are added to the yellow diazo solution with further cooling and thereafter a methazonic acid solution (prepared in known manner by adding 28 g of nitromethane to a mixture of 67 ml of water and 25 g of 100% sodium hydroxide, diluting the solution with 250 ml of ice water and adjusting it to a pH of 5 with 50 ml of glacial acetic acid) is introduced over the course of 15 minutes. The coupling is brought to completion by stirring the reaction mixture for a further 4 hours at the same temperature and then allowing it to rise to room temperature. The dark reddish brown coupling product is collected with suction, washed free of salt with water and dried in vacuo at 50° to 55° C. to yield 65 g of brick-red azo compound.

With stirring, 1.5 g of sodium nitrite are added to a mixture of 360 ml of glacial acetic acid and 90 ml of water at room temperature. After 5 to 7 minutes, 40 g of the above azo compound are added in very finely powdered form and the suspension is stirred for 1½ hours at room temperature. After a further addition of 1 g of sodium nitrite, the reaction mixture is brought in the course of ½ hour to an internal temperature of 65° C., and the cyclisation to give the 3-phenyl-7-(4-hydroxy-1-oxido-v-triazol-2-yl)-coumarin takes place accompanied by a slightly exothermic reaction and the escape of nitrous gases. After a reaction time of 6 hours at 65° to 68° C., the reaction mixture is allowed to cool with stirring. The solid is collected with suction, washed with 150 ml of 50% acetic acid and dried in vacuo at 50° to 55° C. The crude product is purified by stirring it in 275 ml of dimethyl formamide for 1 hour at room temperature and subsequently for 20 minutes at 80° C., then, after cooling, collecting the crystalline cream-coloured product with suction, washing it with 25 ml of dimethyl formamide and subsequently with 80 ml of 95% alcohol and drying it in vacuo. Yield: 16.25 g of 3-phenyl-7-(4-hydroxy-1-oxido-v-triazol-2-yl)-coumarin in the form of a slightly cream-coloured crystalline powder with a melting point of 229° C. (with decomp.).

A sample recrystallised from methyl cellosolve gives almost colourless crystals. Melting point: 233°–234° C. (decomposition).

With efficient stirring, 24 g of the above 3-phenyl-7-(4-hydroxy-1-oxido-v-triazol-2-yl)-coumarin are suspended in 600 ml of dioxan. Then 35 g of zinc dust are added to the suspension, which is heated to 80° C. 125 ml of 6N sulphuric acid are added over 2 hours while an internal temperature of 85° to 87° C. is maintained and stirring is subsequently continued for 2 hours at the same temperature. Zinc/zinc sulphate sludge is filtered off warm with suction and after washing with warm dioxan (100 ml), the light yellow filtrate is concentrated in vacuo until the onset of crystallisation and poured into a mixture of 1200 ml of water and 25 ml of conc. hydrochloric acid. The light yellow product which precipitates is separated, washed with 1% acetic acid and dried at 60° to 70°. One crystallisation from o-dichlorobenzene with fuller's earth gives 15.4 g of 3-phenyl-7-(4-hydroxy-v-triazol-2-yl)-coumarin in almost colourless fine crystals with a melting point of 258°–259° C.

The coumarins of the formula (102)

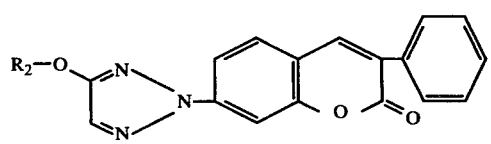

can be obtained in analogous manner by alkylation or aralkylation.

| Formulae | $R_2$ | Melting point ° C |
|---|---|---|
| 103 | $-C_2H_5$ | 155 – 156 |
| 104 | $-C_4H_9(n)$ | 145 – 146 |
| 105 | 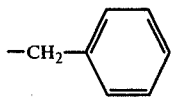 | 155 – 155.5 |

EXAMPLE 2

5.8 g of 3-phenyl-7-(4-hydroxy-5-chloro-v-triazol-2-yl)-coumarin are dissolved at room temperature in 75 ml of dimethyl formamide. After addition of 5.67 g of potassium carbonate, 0.27 g of potassium iodide and 2.8 ml of n-butyl bromide, the reaction mixture is heated in the course of 20 minutes to an internal temperature of 80° to 85° C. and stirred for 8 hours in this temperature range. After the reaction mixture has been poured into 1000 ml of water, the pH is adjusted to 3 with 2N sulphuric acid. The precipitated product is filtered off with suction, washed free of salt with water and dried. One crystallisation from toluene with fuller's earth yields 5.6 g of the compound of the formula

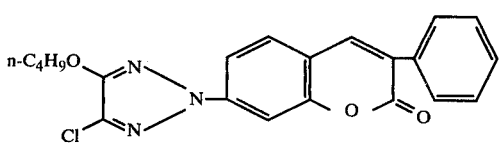

(201)

in the form of slightly beige-coloured crystals with a melting point of 185°–186° C.

The 3-phenyl-7-(4-hydroxy-5-chloro-v-triazol-2-yl)-coumarin used as starting material was prepared as follows:

With stirring, 11.3 g of 3-phenyl-7-(4-hydroxy-1-oxido-v-triazol-2-yl)-coumarin (prepared as described in Example 1) are added to a mixture of 150 ml of dioxan and 5.5 ml of 37.2% hydrochloric acid and the mixture is heated to the boil at reflux while simultaneously introducing a moderate flow of gaseous hydrochloric acid into the reaction mixture. After a reaction time of 8 hours, the batch is poured into 1000 ml of water. After several hours, the precipitated product is collected with suction, washed with water and dried. Recrystallisation from o-dichlorobenzene with the aid of fuller's earth yields 6 g of 3-phenyl-7-(4-hydroxy-5-chloro-v-triazol-2-yl)-coumarin in almost colourless crystals. Melting point: 284°–286° C.

Repetition of the above procedure using an excess of methyl iodide instead of n-butylbromide gives the compound of the formula

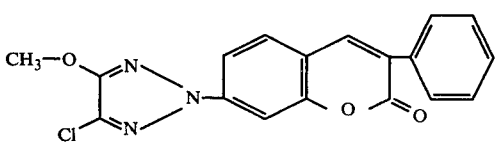

(202)

Recrystallisation from isopropanol gives colourless crystal needles with a melting point of 191.5°–193° C.

EXAMPLE 3

Using softened water, a bath is prepared which contains, per liter, 0.16% (referred to the weight of the fabric to be brightened) of the compound of the formula (101), (103), (104), (105) or (201) (which has been predispersed with a small amount of water and approx. 1 gram of a dispersant, e.g. an ethoxylated stearyl alcohol) and approx. 2 g of a carrier. A suitable carrier is, for example, a mixture of dodecylbenzenesulphonate (as triethanolamine salt), ethoxylated ricinolic acid, n-hexanol and ethylene glycol in 1,2,4-trichlorobenzene.

A polyester fabric is put into this bath at 40° C. (liquor ratio 1:25). The bath is heated to 97° C. in the course of 30 minutes and held at this temperature for a further 30 minutes. After rinsing and drying, a very strongly brightened polyester fabric is obtained.

EXAMPLE 4

A cellulose acetate fabric is put at 50° C. into an aqueous bath (liquor ratio 1:30 to 1:40) which contains 0.15% (based on the weight of the fabric) of the compound of the formula (101), (103), (104) or (105). The temperature of the treatment bath is brought to 90°–95° C. and kept thereat for 30 to 45 minutes. After the fabric has been rinsed and dried, a good white effect is obtained.

EXAMPLE 5

A polyamide fabric (Perlon) is put at 60° C., in the liquor ratio of 1:40, into a bath which contains (referred to the weight of the fabric) 0.1% of a fluorescent brightener of the formula (101), (103) or (104) and, per liter, 1 g of 80% acetic acid and 0.25 g of an adduct of 30 to 35 moles of ethylene oxide and 1 mole of commercial stearyl alcohol. The bath is heated within 30 minutes to boiling temperature and kept at the boil for 30 minutes. The fabric is then rinsed and dried. A strong white effect of good light fastness is obtained.

Similar white effects are obtained by using a fabric made of polyamide 66 (nylon) instead of polyamide 6.

Finally, it is also to carry out the process under high temperature conditions, e.g. over the course of 30 minutes at 130° C. For this kind of application it is advisable to add 3 g/l of hydrosulphite to the liquor.

EXAMPLE 6

A polyester fabric (e.g. "Dacron") is padded at room temperature with an aqueous dispersion which contains, per liter, 2 g of a compound of the formula (101), (103), (104), (105) or (201) as well as 1 g of an adduct of approx. 8 moles of ethylene oxide and 1 mole of p.tert.-octylphenol, and dried at approx. 100° C. The dry material is subsequently subjected to a heat treatment at 150° to 220° C., which lasts from 2 minutes to a few seconds, depending on the temperature. The treated material has a markedly whiter appearance than untreated material.

EXAMPLE 7

A modified polyester fabric (Dacron 64 ®) prepared from co-condensation of 2 to 5 molar percent of isophthalic acid-5-sodium sulphonate is padded to a liquor pick-up of 70% with a liquor containing, per liter, 2.5 g of the compound of the formula (101), (103), (104), (105) or (201) and 0.1 g of an adduct of 2 to 5 moles of ethylene oxide and 1 mole of polyphenol. The fabric is dried for 20 minutes at 70° C. The dry fabric is subsequently thermofixed for 30 seconds at 220° C., washed for 30 minutes at 97° C. at a liquor ratio of 1:30 in a wash liquor which contains, per liter, 5 g of soap and 2 g of sodium carbonate, rinsed in running cold water and finally dried with a hot iron at 180° C.

The treated fabric has a markedly whiter appearance than untreated fabric.

I claim:

1. 3-Phenyl-7-(v-triazol-2-yl)-coumarins of the formula

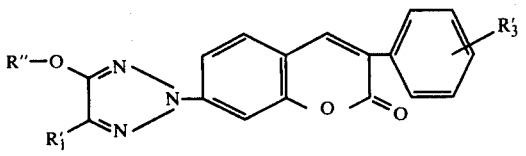

wherein

R'' represents an alkyl group of 1 to 4 carbon atoms, an allyl or benzyl group, $R_1'$ represents a hydrogen or chlorine atom, and $R_3'$ represents a hydrogen atom, a chlorine atom, an alkyl or alkoxy group of 1 to 4 carbon atoms.

2. 3-Phenyl-7-(v-triazol-2-yl)-coumarins according to claim 1 of the formula

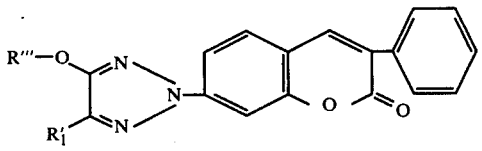

wherein

R''' represents an alkyl group of 1 to 4 carbon atoms or a benzyl group, and $R_1'$ represents a hydrogen or chlorine atom.

* * * * *